United States Patent [19]

Guidry

[11] 4,235,052

[45] Nov. 25, 1980

[54] FAN DISC

[76] Inventor: Joseph L. Guidry, 219 Dolores, San Francisco, Calif. 94103

[21] Appl. No.: 1,882

[22] Filed: Jan. 8, 1979

[51] Int. Cl.[3] ..... B24D 13/18; B24B 23/02; B24D 9/08

[52] U.S. Cl. ..... 51/358; 51/170 T; 51/266; 51/356; 15/230.1

[58] Field of Search ..... 51/170 T, 209 R, 266, 51/270, 273, 356, 358, 376, 378, 394; 15/230.1, 385; 416/2, 132 R, 183, 185, 240 R

[56] References Cited

U.S. PATENT DOCUMENTS

| | | | |
|---|---|---|---|
| 1,485,649 | 3/1924 | Van Leggelo | 416/183 |
| 2,217,231 | 10/1940 | Morse | 416/185 |
| 2,599,952 | 6/1952 | Strayer | 51/266 |
| 2,966,333 | 12/1960 | Flanagan | 416/2 |
| 3,187,475 | 6/1965 | Sopcak et al. | 51/378 X |
| 3,574,975 | 4/1971 | Liss | 51/356 X |
| 3,952,712 | 4/1976 | Hermanson | 416/240 X |
| 3,974,598 | 8/1976 | Guidry | 51/356 X |
| 4,069,538 | 1/1978 | Fallen | 51/230.1 X |

*Primary Examiner*—Gary L. Smith
*Assistant Examiner*—Robert P. Olszewski
*Attorney, Agent, or Firm*—Alvin E. Hendricson

[57] ABSTRACT

An improvement in backing discs for rotary sanders and the like has a plurality of radially offset blades on a back surface thereof with each blade being formed of a plurality of separate elements for flexibility of the blades and disc and the elements of each blade are formed to deflect upon striking a solid object.

5 Claims, 6 Drawing Figures

FAN DISC

BACKGROUND

Backing discs for rotary sanders and the like are formed of limitedly flexible material for carrying abrasive material and numerous improvements have been developed including the provision of ridges or ribs to control disc rigidity and assist in cleaning and cooling abrasive sheet material on the disc. A recent major advance in this field is disclosed and claimed in the U.S. Pat. No. 3,974,598 wherein particularly oriented blades direct sanded particles in a single direction from a work piece operated upon by the disc.

The present invention comprises an improvement in the fan disc of U.S. Pat. No. 3,974,598. One of the major advantages of the above-noted fan disc is the capability for use on portable equipment wherein the backing disc is operated out in the open without any type of hood or cover and yet sanded particles are discharged in a single predetermined direction. While this result is truly amazing, it is noted that the vanes or blades on the backing disc are exposed during disc rotation. It is thus possible for an operator to inadvertently touch one or more vanes. Although proper handling of a portable sander, for example, should preclude an operator from touching the vanes on the back of the disc, it is possible for mistakes to occur with damaging results to the operator. Rotary sanders and the like normally operate at high speed, so that an operator who inadvertently places a finger tip or knuckle, for example, too close to the back of the disc may be injured. It is also noted that the blades on the back surface of this type of disc limit the flexibility of the disc and this may be disadvantageous in at least certain circumstances.

SUMMARY OF INVENTION

The present invention provides blades upon the rear surface of a backing disc for a rotary sander or the like, as in U.S. Pat. No. 3,974,598, but which blades have only a limited rigidity and which will deflect upon striking a solid object. The improved backing disc of the present invention has each of the blades or vanes thereon formed of a plurality of relatively small elements in the form of bristles or thin plates or the like, so that they will have a sufficient rigidity in combination to direct air in a stream away from the disc, but which are physically moveable by impact with a solid object.

The limited flexibility of the vanes of the present invention serves two purposes. First the vanes present a deflectable surface to solid objects, such as a finger or knuckle of an operator so that a person who inadvertently touches a vane on a rotating disc will not be injured thereby. Second, the disc itself may be more readily bent or slightly deflected in use. Commonly, the disc with sandpaper or the like thereon is rotated and placed against a work piece at some small angle thereto so as to deflect the rotating disc at one side thereof. Limited flexibility of the vanes thus facilitates use of the backing disc of the present invention and the present invention enhances this flexibility while yet directing sanded particles, for example, in a stream away from a work piece.

DESCRIPTION OF FIGURES

The present invention is illustrated as to particular preferred embodiments in the accompanying drawings, wherein.

DESCRIPTION OF PREFERRED EMBODIMENTS

Figure 1:
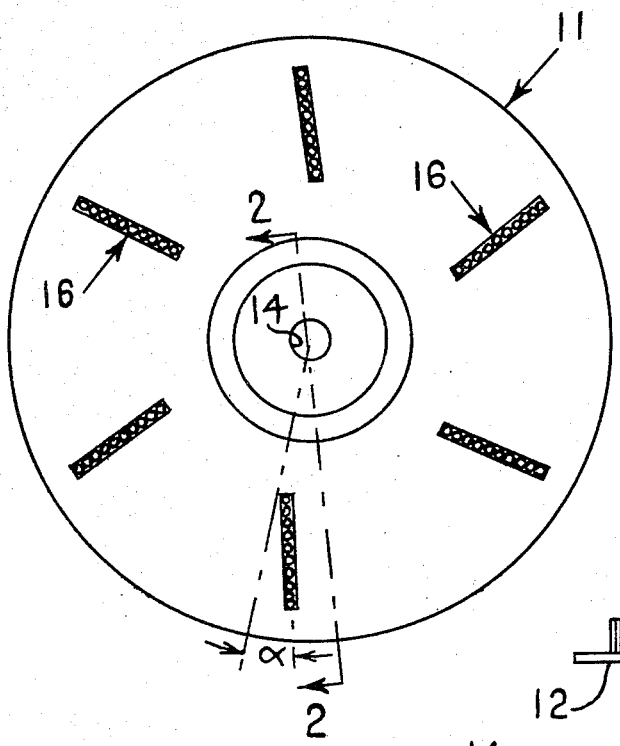
FIG. 1 is a rear plan view of a backing disc in accordance with the present invention.
Figure 2:
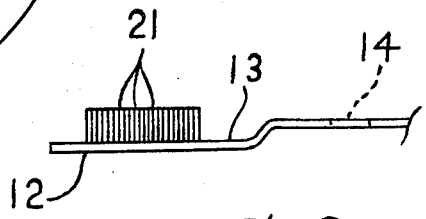
FIG. 2 is a partial sectional view taken in the plane 2—2 of FIG. 1.

The backing disc 11 of the present invention, as illustrated in FIGS. 1 and 2 of the drawings, is formed as a circular plate or disc of a limitedly flexible material, such as a suitable plastic or the like. The disc has a substantially flat front face 12 adapted to receive a disc of abrasive material, such as sandpaper or the like, and may include a central depression whereat the abrasive material is secured to the front face of the disc. The disc also has a substantially flat back face 13 which may include a central raised portion with an axial aperture 14 therethrough for attachment of the disc to a rotary driven shaft.

Upon the back face 13 of the disc there are provided a plurality of blades or vanes 16 which extend upwardly from the back face and which are spaced equally about this face. The individual blades 16 have somewhat of a rectangular configuration in side view and each are offset with respect to a radius of the disc by an angle $\alpha$, as indicated in FIG. 1. With the disc being adapted for rotation in a clockwise direction, the blades are disposed with the outer ends thereof in trailing relation to the inner ends and, as noted above, each of the blades make an angle $\alpha$ and with a radius of the disc through the inner leading edge of the fin. The angular offset of the individual fins may be varied somewhat and an angle of the order of 10°-15° has been found to be advantageous, although this angle may be somewhat larger. It is also noted with regard to the blades 16 that the configuration thereof need not be exactly planar and in plan view, the blades may even have some curvature to present a concave leading surface.

Figure 3:
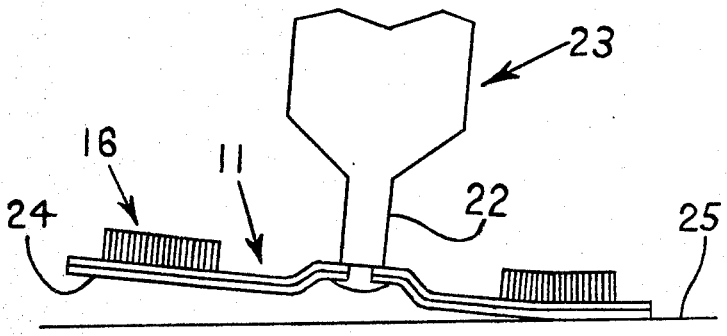
FIG. 3 is a central vertical sectional view of a backing disc in accordance with the present invention in use on a rotary sander.

The blades 16 of the present invention are each formed of a plurality of separate elements, such as bristles or thin rods 21 which are preferably formed integrally with the disc. By forming each fin or blade of a plurality of separate elements spaced slightly apart on the back face of the disc, there is provided a flexibility of each fin or blade. This is advantageous in allowing the disc to be flexed or bent somewhat from the outer periphery thereof inwardly during use of the disc, as shown in FIG. 3. The separate elements, such as the bristles 21 of each blade are spaced close enough together that the combination thereof present a relatively solid surface to thus operate in the manner of the blades of the fan disc of the above-noted patent wherein air is directed outwardly from the disc as the disc is rotated and sanded particles or the like are entrained therein to be directed away from the disc in a single direction.

Consequently, the improved fin or blade structure of the present invention not only provides for the advantageous discharge of sanded particles in the atmosphere, but also improves the operation of the disc itself because the blade flexibility allows the disc to be bent again, as illustrated in FIG. 3 of the drawings.

Referring to FIG. 3, there will be seen to be shown the disc 11 attached to a shaft 22 of a rotary sander or the like 23, adapted to rotate the disc. A sheet of sandpaper 24 is affixed to the front or under surface of the disc and the sandpaper is then pressed against a work surface 25 by the rotating disc. It will be seen that with the blade composition of the present invention, it is possible to deflect the backing disc during use inasmuch as the individual blades do not unduly stiffen the disc.

Figure 4:
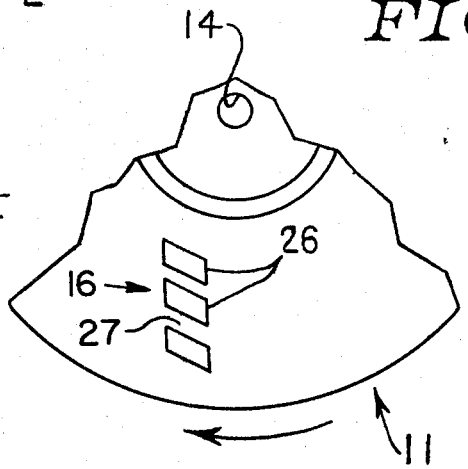
FIG. 4 is a partial plan view of an alternative embodiment of the present invention.
Figure 5A:
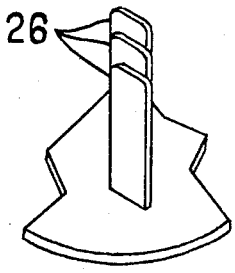
FIGS. 5A and 5B are partial perspective views of individual blades of alternative configurations in accordance with the present invention.

Division of each fin or blade into a plurality of separate elements disposed perpendicularly to the back of the backing disc may be accomplished in a variety of ways and reference is made to FIGS. 4 and 5 illustrating alternative embodiments of the present invention. As shown in FIG. 4, each of the blades 16 may be comprised as a row of thin upstanding plates 26 which are laterally inclined to the axial plane of the central fin. The individual plates 26 of each blade 16 are made quite thin and are spaced closely together and the plates are disposed in parallel slanted relationship to the plane of the blade with the slots 27 therebetween slanted crosswise to the direction of rotation of the disc, as shown. The elements of each blade, and thus the slots therebetween, are disposed at an acute angle to the axis of the blade on the trailing side of the blade so that any air passing through the slots is directed outwardly of the disc.

The blades of the present invention, which are each formed of a plurality of thin parallel plates, as described above, operate in the same manner as solid blades or fins to deflect air in a well defined stream for directing sanded particles or the like, in a single predetermined direction from the backing disc and work piece. It is, however, to be particularly noted that the individual plates or elements 26 of each blade 16 are oriented to present a substantially flat surface to air engaged thereby, i.e. the plates are substantially inclined with respect to the central vertical plane of each blade. This embodiment of the present invention also provides the advantage of limiting the blade resistance to impact with a solid object, such as a part of the hand of an operator, for example. The very thin configuration of the individual plates provides for ready bending or deflection thereof upon impact and yet the closely-spaced multiplicity of plates accomplishes the deflection of air masses, as required by the present invention.

Figure 5B:
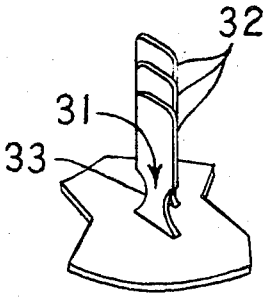

A further alternative of the present invention, as generally illustrated in FIG. 5B, provides for destructive deflection of individual plates or elements of each blade or fin upon impact with a solid object. This embodiment provides each plate or element with a weakened base portion which may, for example, take the form of a reduced plate cross section, as illustrated at 31 of the plates or elements 32. Adjacent the base of each plate 32, there is shown to be provided an indentation 33 on one or both sides of each plate immediately above the disc 11. These indentations reduce the cross section of each plate so as to provide a "break-line" therebetween at which each blade or fin will destructively deflect, i.e., break upon experiencing a sufficient impact force, such as impact with a solid object. The indentations 33 may be provided one on each lateral side of each plate, as shown, or may alternatively be provided only on one lateral side or upon front and/or back sides of each plate, and criteria being that a weakened section of each plate is provided adjacent the base thereof. It is, of course, also theoretically possible to otherwise weaken each plate adjacent the base thereof as by a variation of the chemical composition of each plate, however, practical manufacturing techniques for the present invention do not favor this approach.

There has been described above, a number of alternative embodiments of the present invention, each of which accomplish the two objectives of the present invention, i.e., the generation of a particularly directed air stream to carry particles in a predetermined direction away from a workpiece and, at the same time, to deflect upon impact with a solid object, such as a finger or the like, of an operator. Thus the present invention accomplishes the objective of the above-noted U.S. Pat. No. 3,974,598, and also provides a safety factor of great importance to operators of devices, such as the present invention. There is consequently provided a material advancement in the art by the present invention.

There has been described above, a number of preferred embodiments of the present invention, however, it will be appreciated by those skilled in the art, that numerous other variations or modifications are possible within the spirit and scope of the present invention, and consequently, there is no intent to limit the present invention to the details of illustrations or precise terms of description.

What is claimed is:

1. An improved backing disc having a front face adapted to engage an abrasive material adapted to be rotated in a predetermined direction and having a plurality of blades extending from a back surface thereof in angularly offset relation to radii of said disc in outward trailing relation to the direction of disc rotation characterized by each of said blades being formed of a plurality of elements of limited cross section together defining a blade which is deflectable upon impact with a solid object.

2. The backing disc of claim 1 further defined by the elements of each of said blades comprising bristles formed integrally with said disc.

3. The backing disc of claim 1 further defined by each of said blades comprising a plurality of thin substantially parallel plates.

4. The backing disc of claim 3 further defined by said plates of each blade being disposed in parallel inclined relation to a central plane of the blade to present a substantially solid surface to air engaged by the blade as the disc is rotated.

5. The backing disc of claim 3 further defined by each of the plates of each blade having a weakened section adjacent said disc for breaking of the plate upon forceable impact with a solid object.

* * * * *